US006046714A

United States Patent [19]

Lim

[11] Patent Number: 6,046,714

[45] **Date of Patent: *Apr. 4, 2000**

[54] FLAT DISPLAY EMPLOYING LIGHT EMITTING DEVICE AND ELECTRON MULTIPLIER

[75] Inventor: Koeng-Su Lim, Taejon, Rep. of Korea

[73] Assignee: Korea Advanced Institute of Science and Technology, Taejon, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 08/807,335

[22] Filed: Feb. 28, 1997

[30] Foreign Application Priority Data

Feb. 29, 1996 [KR] Rep. of Korea ..... 96-5328

[51] Int. Cl.[7] ..... G09G 3/00

[52] U.S. Cl. ..... 345/81; 313/525; 313/528; 313/103 CM; 313/105 CM

[58] Field of Search ..... 345/76, 75, 211, 345/213, 81; 348/798; 313/293–304, 495, 497, 315, 483, 361.1, 525, 527, 532, 537, 542, 105 R, 105 CM, 103 R, 103 CM; 315/167

[56] References Cited

U.S. PATENT DOCUMENTS

| | | | |
|---|---|---|---|
| 4,429,303 | 1/1984 | Aboelfotoh | 340/701 |
| 4,622,492 | 11/1986 | Barten | 313/422 |
| 4,691,099 | 9/1987 | Johnson | 313/528 |
| 4,780,395 | 10/1988 | Saito et al. | 313/103 CM |
| 5,461,396 | 10/1995 | Nakatani et al. | 345/75 |
| 5,495,141 | 2/1996 | Thomas | 313/525 |
| 5,625,253 | 4/1997 | Gorkom et al. | 313/422 |
| 5,652,067 | 7/1997 | Ito et al. | 428/690 |
| 5,691,738 | 11/1997 | Arai et al. | 345/76 |
| 5,721,562 | 2/1998 | Kawashima et al. | 345/76 |
| 5,747,928 | 5/1998 | Shanks et al. | 345/76 |
| 5,748,159 | 5/1998 | Nishio et al. | 345/76 |
| 5,764,205 | 6/1998 | Doyle et al. | 345/75 |
| 5,781,169 | 10/1996 | Kuijk et al. | 345/76 |
| 5,786,794 | 7/1998 | Kishi et al. | 345/76 |

OTHER PUBLICATIONS

K. Nonomura et al., A40–in. Matrix–Driven High–Definition Flat–Panel CRT, SID 89 Digest: 106–109 (1989).

A.P. Sliski et al., Bright High–Definition CRTs Using a Laser–Driven Photoelectron Source, SID 92 Digest: 334–335 (1992).

A.W. Woodhead et al. The channel Multiplier Cathode Ray Tube, Proc. Sid (23/3):113–122 (1982).

E. Miyazaki and Y. Sakamoto, A Flat CRT with Multiple Vertically Deflected Beams, Proc. SID (29/1):19–022 (1988).

D. Washington, Color Disoplay Using the Channel Miltiplier CRT, Proc. SID (29/1):23–31 (1988).

J.R. Mansell et al., The Achievement of Color in the 12–in. Channel–Multiplier CRT, Proc. SID (29/3):201–205 (1988).

K. Yamamoto et al., A14–in. Color Flat–Panel Display Using Filament Cathodes, SID 94 Digest: 381–384 (1994).

*Primary Examiner*—Lun-Yi Lao
*Attorney, Agent, or Firm*—Darby & Darby

[57] ABSTRACT

The present invention related to a flat display employing light emitting device and electron multiplier. A flat display of the present invention is fabricated to comprise the following three parts: an electron emission part of a flat substrate, light emitting device being arrayed at regular intervals in one side of the substrate and driven by video signal voltage, and photoelectric material being coated on the other side of the substrate; an electron multiplication part which comprises an electron multiplier for multiplying electrons emitted from the electron emission part and a power supply of high voltage D.C. to provide driving force therefor; and, a phosphor-activated luminescence part made of a glass coated with red(R), green(G) and blue(B) phosphors corresponding to the light emitting device by one-to-one in a matrix array, which activates each R, G or B phosphor to emit light by accelerating and colliding electrons passing through the electron multiplier with the phosphor-coated side of the glass.

7 Claims, 2 Drawing Sheets

FLAT DISPLAY EMPLOYING LIGHT EMITTING DEVICE AND ELECTRON MULTIPLIER

FIELD OF THE INVENTION

The present invention relates to a flat display employing light emitting device and electron multiplier, more specifically, to a novel flat display which comprises an electron emission part of a flat glass substrate, where light emitting device is arrayed in one side and photoelectric material is coated on the other side, an electron multiplication part for multiplying emitted electrons, and a phosphor-activated luminescence part made of a glass coated with phosphor.

BACKGROUND OF THE INVENTION

Displays such as a cathode ray tube (CRT also known as Braun tube) display, a liquid crystal display(LCD), a plasma display panel(PDP) and an electroluminescent display (ELD), etc., have been conventionally used in the art.

Among them, a CRT display has been most widely used in TV, computer terminal, etc., since it has advantages over the others in light of display quality and economical efficiency, etc. CRT which is a vacuum tube consisting of an electron beam emission part, an electron beam modulation part, an electron beam deflection part and an electron beam activation part, works on the following principle: thermionic beam emitted from a cathode is concentrated and accelerated into a form of thin beam by electron lens system, and deflected to collide with phosphor coating the inner part of frontal vacuum tube, which finally activates the phosphor to give luminscence. Though CRT has advantages of high brightness, good color and display contrast, and easy scanning and modulation, it has revealed a critical shortcoming that the larger a screen is, the heavier and larger the CRT is.

Though studies on a flat-plane CRT display have been carried out to overcome the said problems appeared in the CRT, remarkable results have not been obtained. For example, a flat CRT which employs microchannel plate (MCP) has been suggested in the art, however, it has not been commercialized, since it, like the conventional CRTs, utilizes the method for electron emission using one electron gun, and travelling path of electrons is complex, which raises an obstacle in the enlargement of area.

LCD is a flat display using modulation of beam by liquid crystal, and has advantages over the conventional displays, in light of low electric power consumption and low operation voltage requirement. Since flat shape, light weight and colorized display can be realized in LCD, it has been widely used in a portable display, etc. However, LCD has also shortcomings that viewing angle is limited and utility of back light is low, since display contrast depends on viewing direction. Moreover, problems of poor operation at low temperatures and frequent deterioration of liquid crystal are inevitably raised in LCD, owing to the response characteristics depending on the surrounding temperature.

PDP is a flat display using luminiscence generated by D.C. (direct current) or A.C. (alternating current)-driven electric discharge of inert gas. It has advantages over the conventional displays, in light of thin film-like structure, high response speed, and increased display contrast. Moreover, use of phosphor permits colorized display, and developing into a large-area screen is facilitated. However, since PDP utilizes plasma discharge generating in minute space, size of pixel can not be decreased, which naturally limits the development of highly definite screen.

ELD is a display whose pixel is provided by electroluminescent device. The electroluminescent device, depending on luminescence mechanism, is classified into intrinsic and charge injection-type electroluminescent devices. In general, the intrinsic and charge injection-type electroluminescent devices are called as electroluminescent (EL) device and light emitting diode(LED), respectively, and a flat display using the intrinsic electroluminescent device is generally represented as "ELD". A flat display using EL device has an advantage that developing into a large-area screen is facilitated, and brightness of red(R) and green(G) is high. However, it has revealed shortcomings that brightness of blue(B) luminescent device is low, which blocks the development of perfectly colorized display.

Generally, LED is classified into bulk-type LED employing a crystalline semiconductor such as GaAs and thin film-type LED employing an amorphous semiconductor such as a-SiC or organic material. A flat display employing the bulk LED has a difficulty in performance of blue LED of high efficiency, which also blocks the development of perfectly colorized display. Also, a large-area screen can not be achieved, due to the employment of crystalline semiconductor. On the contrary, a flat display using the thin film LED realizes a large-area screen and perfect colorization, while it has a short life span, owing to early deteriorization of luminescence device.

SUMMARY OF THE INVENTION

The present inventors have made an effort to solve the problems of the prior art displays, and fabricated a novel flat display comprising an electron emission part made of a flat substrate, where light emitting device is arrayed in one side and photoelectric material is coated on the other side, an electron multiplication part for multiplying emitted electrons, and a phosphor-activated luminescence part made of a glass coated with phosphor.

In order to permit pixels (phosphors) of red(R), green(G) and blue(B) in the glass of the phosphor-activated luminiscence part to emit light, the flat display is designed to have a structure in which each light emitting device arraying in one side of the substrate of the electron emission part corresponds to R, G or B pixel by one-to-one and video signal voltage is taken to the light emitting device. The flat display has very simple and thin structure of less than 2–3 cm. Also, the lowered driving voltage of the light emitting device, leads to remarkably decreased injected current density, which, in turn, prevents the deterioration of light emitting device. Moreover, photoelectric material coated on the substrate of the electron emission part properly emits activated electrons, which are multiplied by the aid of the electron multiplication part, guarantees a long life and high brightness. Also, the flat display is fabricated to have large-area, highly definite and perfectly colorized screen, while electric power consumption is very low.

A primary object of the present invention is, therefore, to provide a novel flat display which realizes large-area, highly definite and colorized screen of high brightness and long life.

BRIEF DESCRIPTION OF DRAWINGS

The above and the other objects and features of the present invention will become apparent from the following description given in conjunction with the accompanying drawings, in which.

DETAILED DESCRIPTION OF THE INVENTION

A flat display of the present invention is fabricated to comprise the following three parts:

an electron emission part of a flat glass substrate, light emitting device being arrayed at regular intervals in one side of the substrate and driven by video signal voltage, and photoelectric material being coated on the other side of the substrate;

an electron multiplication part which comprises an electron multiplier for multiplying electrons emitted from the electron emission part and a power supply of high voltage D.C. to provide driving force therefor; and, a phosphor-activated luminescence part made of a glass coated with red(R), green(G) and blue(B) phosphors corresponding to the light emitting device by one-to-one in a matrix array, which activates each R, G or B phosphor to emit light by accelerating and colliding electrons passing through the electron multiplier with the phosphor-coated side of the glass.

In accordance with the flat display of the invention, the electron emission part may comprise two sheets of substrate instead of the flat glass substrate, where light emitting device is arrayed in one side of a sheet and photoelectric material is coated on one side of the other sheet. In this connection, the flat substrate for light emitting device array may be a ceramic plate, a metal plate, a semiconductor substrate or a polymer film, and a glass as well, and the light emitting device may be thin film light emitting diode(TFLED), bulk LED, intrinsic EL device or laser diode (LD). Also, microchannel plate (MCP), metal sheet dynode or other types of electron multipliers which can multiply emitted electrons may be employed as the electron multiplier of an electron multiplication part.

The flat display of the invention may further comprise power supplies of high voltage D.C. for accelerating the electrons emitted from the substrate of an electron emission part, or for accelerating and colliding the electrons multiplied in the electron multiplication part with the glass coated with phosphor.

Preferred embodiments of the present invention are explained in more detail with references of the accompanying drawings, which should not be taken to limit the scope of the invention.

Figure 1:
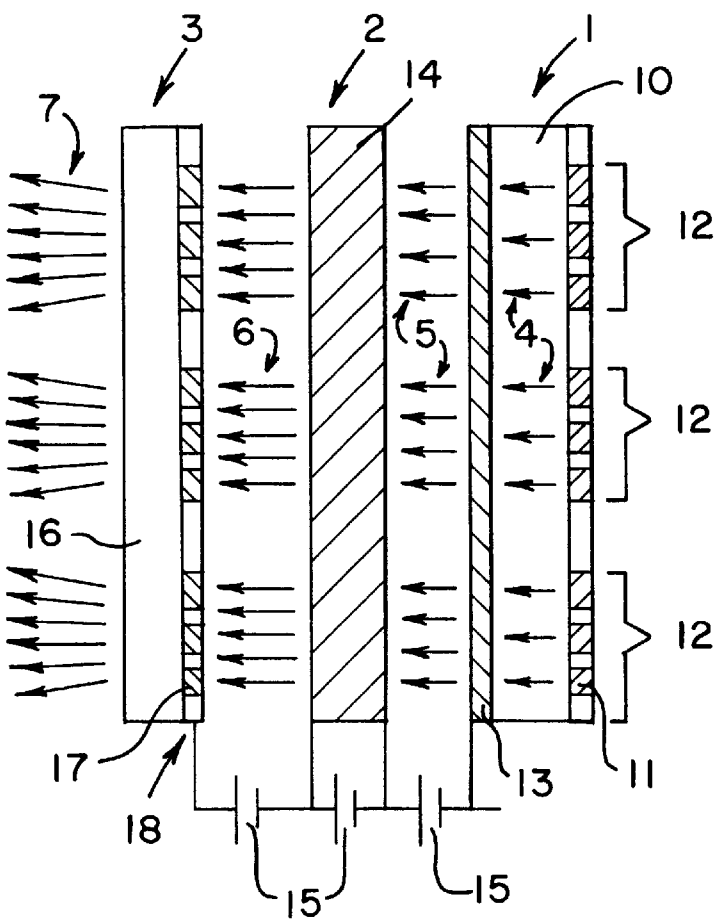
FIG. 1 is a schematic diagram showing a flat display in accordance with a preferred embodiment of the present invention.
Figure 2:
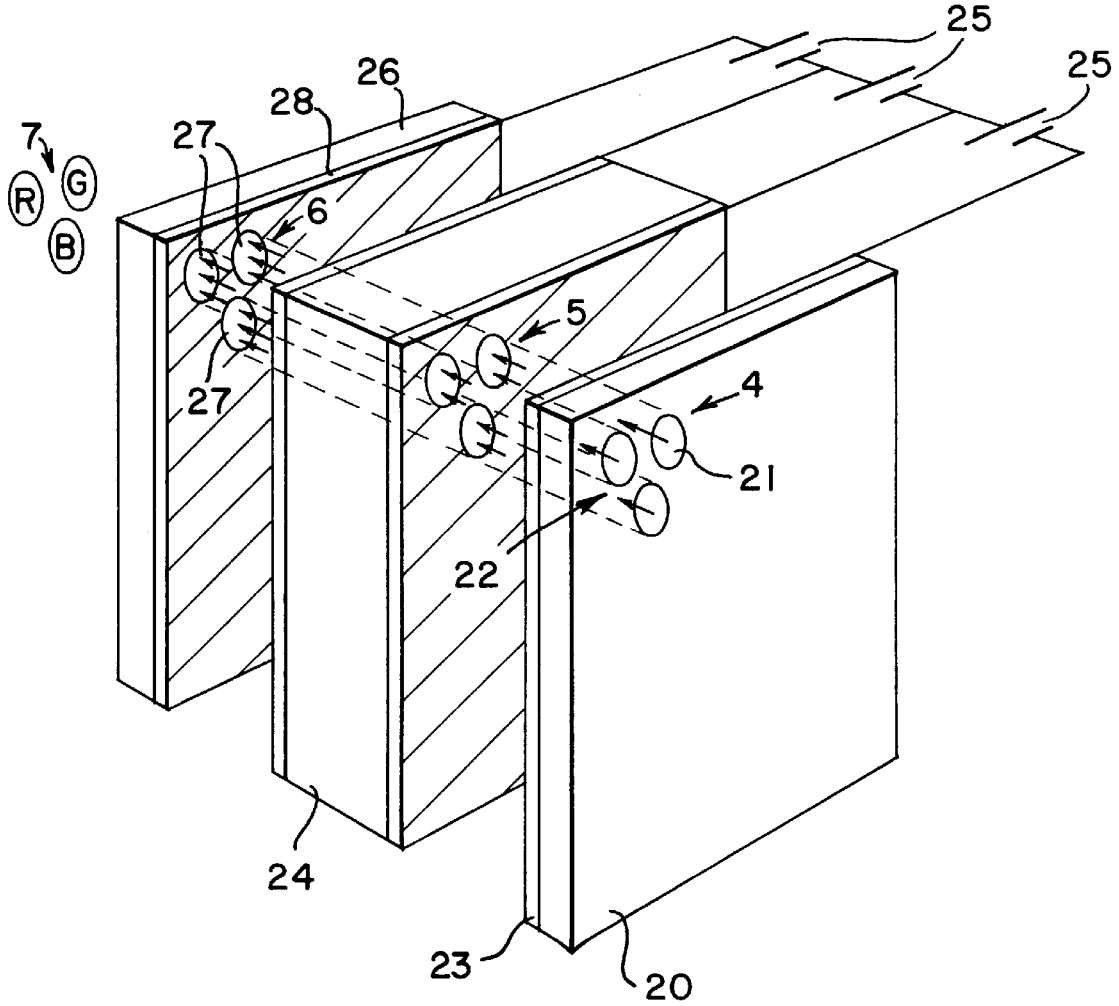
FIG. 2 is a schematic diagram showing the operation mode of the flat display of the invention.

FIG. 1 is a schematic diagram showing a flat display in accordance with a preferred embodiment of the present invention; FIG. 2 is a schematic diagram showing the operation mode of the flat display; and, FIG. 3 is a schematic diagram showing a flat display comprising an electron emission part using two sheets of plate in accordance with the other preferred embodiment of the invention.

Figure 3:
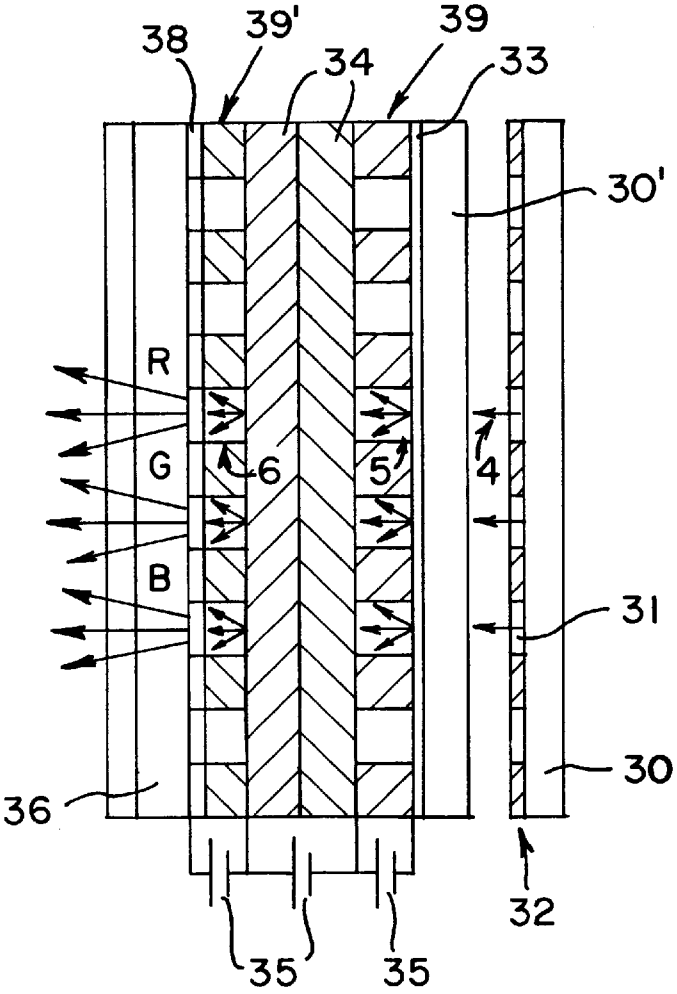
FIG. 3 is a schematic diagram showing a flat display comprising an electron emission part using two sheets of substrate in accordance with the other preferred embodiment of the invention.

Referring to FIGS. 1 to 3, a photoelectric material(13, 23, 33)-coated substrate(10, 20, 30') of an electron emission part faces a phosphor(17, 27, 37)-coated glass(16, 26, 36) of a phosphor-activated luminescence part, and an insulator(39), an electron multiplier(14, 24, 34) and an insulator(39') are positioned in the space between the two plates. The flat display of the invention is fabricated by exhausting under a pressure of $10^{-6}$ to $10^{-7}$ torr, sealing up, and vacuumizing the inside. In this connection, a getter for maintaining vacuum may be optionally employed within the inside.

The electron emission part(1) of the flat display is equivalent to a cathode of the conventional CRTs which emits thermionic beams. The electron emission part, referring to FIGS. 1 and 2, consists of a glass(10, 20), light emitting device(11, 21) arrayed at regular intervals in one side of the glass to emit light by R, G, B video signal, and photoelectric material(13, 23) coated on the other side of the glass. Referring to FIG. 3, the electron emission part may comprise two sheets of substrate: That is, it may be fabricated to comprise light emitting device(31) arrayed at regular intervals in one side of a substrate(30) to emit beam in a response to R, G. B video signal, and photoelectric material(33) coated on one side of the other substrate(30'). The beam(4) emitted from the light emitting device(11, 21, 31) arrayed in one side of the substrate(10, 20, 30) generates electrons(s) by the photoelectric material(13, 23, 33) coated on the other side of the substrate(10, 20) (in FIG. 3, one side of the substrate(30')). The electron emission part (1) can be simply fabricated by forming light emitting device (11, 21, 31) in a matrix array in one side of the substrate(10, 20, 30) and coating photoelectric material(13, 23, 33) on the other side of the substrate (10, 20)(in FIG. 3, one side of the substrate (30')).

Light emitting device employed in the flat display of the invention emits light having an energy(work function) to activate photoelectric material, which includes devices permitting array such as TFLED, bulk LED, intrinsic EL device and LD.

The electron multiplication part(2) which comprises an electron multiplier(14, 24, 34) and a power supply of high voltage D.C. to provide driving force therefor(15, 25, 35), plays a role in multiplying the electrons(5) emitted from the electron emission part(1), by which the electrons may be multiplied and accelerated to give a sufficient luminosity, by colliding with the phosphor(17, 27, 37)-coated side(18, 28, 38) of a glass (16, 26, 36) in the phosphor-activated luminescence part(3).

The electron multiplier may be microchannel plate(MCP) and metal sheet dynode, etc. The electron multiplication part (2) may further comprise a power supply(15, 25, 35) of high voltage D.C. for accelerating the electrons (5) emitted from the photoelectric material-coated side of the glass substrate of an electron emission part(1).

When microchannel plate(MCP) is used as an electron multiplier, incidence of electrons into inlet of MCP channel in which high voltage is applied at both ends, leads to multiplification of incident electrons to reach $10^4$-fold which, in turn, are emitted to its outlet(6). When two sheets of MCP are used, electrons can be multiplied to the extent of $10^7$-fold. While the electron multiplier used in the electron multiplication part has been applied in the conventional image intensifier, fabrication of microchannel of diameter of about 10 $\mu$m and length of about 0.4 mm is very difficult, which blocks development of large-area screen and mass production in a low price. However, MCP may be used for fabricating medium to small-area screen of high definition.

On the other hand, metal sheet dynode, which is fabricated by forming minute pores of diameter of 0.3 mm at regular intervals of 0.7 mm in a matrix array on a thin metal plate having a thickness of 0.15 mm by the aid of chemical etching method, has an advantage of mass production of large-area metal sheet dynode in a low price. Since insulators can be sufficiently inserted and accumulated between the metal sheet dynodes, voltage applied between the metal sheet dynodes allows electrons to incident on minute pores to be multiplied.

The phosphor-activated luminescence part (3) which is made of a glass(16, 26, 36) whose one side(18, 28, 38) is coated with phosphor(17, 27, 37), emits light by colliding with the accelerated electrons, like a phosphor-coated plate of the conventional CRTs. In the luminescence part(3), electrons(6) multiplied in the electron multiplier(14, 24, 34) are accelerated by a power supply(15, 25, 35) of high voltage D.C. and collided with the phosphor(17, 27, 37)-coated side(18, 28, 36) of the glass(16, 26, 36) to emit light(7). The luminescence part may further comprise a power supply(15, 25, 35) of high voltage D.C. for accelerating the electrons(6) multiplied in the electron multiplication part(2) and colliding with the phosphor-coated side(18, 28, 38) of the glass.

The flat display of the present invention has a thickness of less than 2–3 cm which is sum of: an electron emission part(thickness of a substrate, light emitting device arrayed in one side of the substrate, and photoelectric material coated on the other side of the substrate); an electron multiplier of the electron multiplication part; a phosphor-coated glass of the phosphor-activated luminiscence part; and, an insulator positioned in the space between the said plates. Accordingly, the flat display of the invention can be fabricated in a thin film-like form.

When the conventional TFLED using a-SiC, a-SiN or a-SiO, etc. is employed, high injected current density is required for the security of high brightness, which results in severe deterioration of light emitting diode. On the other hand, according to the flat display of the invention employing an electron multiplier such as MCP and metal sheet dynode, etc., the photoelectric material coated on the substrate of the electron emission part is sufficiently activated to emit electron beam, even though injected current density caused by the application of low driving voltage is lowered. Accordingly, the lowed driving voltage and injected current density efficiently prevent the deterioration of light emitting diode, thus the flat display of the invention has a long life and high brightness and expends very low electric power.

Further, large-area and colorized display can be realized, since large-area TFLED employing a-SiC, a-SiN or a-SiO, etc. can be fabricated by the conventional methods such as chemical vapor deposition(CVD), sputter and photo-CVD, etc., or by arraying and attaching bulk LED device or LD device in a matrix array on a proper substrate.

Moreover, a flat display of large-area can be fabricated by employing LED in the electron emission part, simply by increasing the number of X-Y panel in a proportional to the increased number of pixel in X-Y matrix-driven mode, without increasing the size of pixel. Since the response speed of LED is very high, i.e., several ns to several hundred ns, sufficient scan can be realized within the time required to display one screen, even though the size of screen is increased to the level of about 40 inches or more. Accordingly, highly definite screen can be realized in the flat display, even though its screen is enlarged to some extent.

Also, the flat display of the invention has wider viewing angle and higher brightness than LCD, since activation mode of the phosphor to emit light is similar to that of the conventional CRTs. The light emitting device used in the flat display can be sufficiently driven by way of X-Y matrix-driven mode, even though it can also be driven by active/passive circuit which is a modification of the conventional LCD or PDP driving circuit.

Although the preferred embodiments of the present invention have been disclosed for illustrative purpose, those who are skilled in the art will appreciate that various modifications, additions and substitutions are possible, without departing from the scope and spirit of the invention as disclosed in the accompanying claims.

What is claimed is:

1. A flat display which comprises:

an electron emission part of a flat substrate, a plurality of light emitting devices arrayed on one side of said substrate to be driven by video signal voltage to emit light, and photoelectric material on the other side of said substrate to receive the light emitted by said devices and emit electrons;

an electron multiplication part comprising an electron multiplier for receiving and multiplying the electrons emitted from said electron emission part and a power supply to provide driving force for acceleration of the electrons; and a phosphor-activated luminescence part of a transparent plate having the side facing said electron multiplication part coated with red (R), green (G), and blue (B) phosphors in a matrix array corresponding to the pattern of said plurality of light emitting devices, each R, G or B phosphor being activated to emit light by the accelerated electrons corresponding to a light emitting device passing through the electron multiplier impinging with the phosphor-coated side of the glass.

2. The flat display of claim 1, wherein said substrate of said electron emission part is selected from the group consisting of glass, ceramic, metal, semiconductor and a polymer film.

3. The flat display of claim 1, wherein said plurality of light emitting devices is selected from the group consisting of thin film light emitting diode (TFLED), bulk LED, intrinsic EL (electroluminescent) device and laser diode (LD).

4. The flat display of claim 1, wherein said electron multiplier is selected from the group consisting of micro-channel plate (MCP) and metal sheet dynode.

5. The flat display of claim 1 which further comprises a power supply for accelerating the electrons emitted from said photoelectric material-coated substrate of said electron emission part.

6. The flat display of claim 1 wherein said substrate of said electron emission part comprises a first piece having said plurality of light emitting devices on the face facing said electron multiplication part and a second piece opposing said first piece having said photoelectric material on the face facing said electron multiplier part.

7. The flat display of claim 6 wherein said second piece is of transparent material.

* * * * *